US005839227A

United States Patent [19]

Gardner

[11] Patent Number: 5,839,227

[45] Date of Patent: Nov. 24, 1998

[54] SAFETY EDGE FOR AN ELECTRICALLY OPERATED DOOR

[76] Inventor: Andrew Joseph Gardner, 13465 - 40 Street, Edmonton, Alberta, Canada, T5A 3L9

[21] Appl. No.: 902,322

[22] Filed: Jul. 29, 1997

[51] Int. Cl.[6] ..... E05F 15/02

[52] U.S. Cl. ..... 49/27; 200/61.43

[58] Field of Search ..... 49/26, 27, 28; 200/61.43

[56] References Cited

U.S. PATENT DOCUMENTS

| | | | |
|---|---|---|---|
| 3,851,125 | 11/1974 | Deming et al. . | |
| 3,986,577 | 10/1976 | Ebbesson et al. | 200/61.43 X |
| 4,051,336 | 9/1977 | Miller | 49/27 X |
| 4,273,974 | 6/1981 | Miller | 49/27 X |
| 4,785,143 | 11/1988 | Miller . | |
| 4,908,483 | 3/1990 | Miller . | |
| 4,920,241 | 4/1990 | Miller . | |
| 4,954,673 | 9/1990 | Miller . | |
| 4,972,054 | 11/1990 | Miller et al. . | |
| 5,066,835 | 11/1991 | Miller et al. . | |
| 5,079,417 | 1/1992 | Strand | 49/26 X |
| 5,124,511 | 6/1992 | Miller et al. . | |
| 5,148,911 | 9/1992 | Miller et al. . | |
| 5,203,110 | 4/1993 | Hormann . | |
| 5,225,640 | 7/1993 | Miller et al. . | |
| 5,228,492 | 7/1993 | Jou | 49/26 X |
| 5,262,603 | 11/1993 | Miller . | |
| 5,265,324 | 11/1993 | Miller et al. . | |
| 5,299,387 | 4/1994 | Miller et al. . | |
| 5,327,680 | 7/1994 | Miller . | |
| 5,345,671 | 9/1994 | Miller . | |
| 5,384,982 | 1/1995 | Galperin . | |
| 5,418,342 | 5/1995 | Miller . | |
| 5,438,798 | 8/1995 | Plamper et al. | 49/28 |
| 5,481,076 | 1/1996 | Mullet . | |

FOREIGN PATENT DOCUMENTS

| | | | |
|---|---|---|---|
| 0182019 | 5/1986 | European Pat. Off. . | |
| 421756 | 9/1974 | U.S.S.R. | 49/27 |
| WO 96/41062 | 12/1996 | WIPO . | |

OTHER PUBLICATIONS

Doorlec Corporation, Controls and Accessories Catalogue E113, undated, pp. 11 and 12.

Materials of Barcol Door Ltd., undated, 2 pages.

Drawing of a Standard Modern Style Overhead Door, undated, 1 page (16).

Drawing of a Typical Mechanical over Electric "Safety Edge" or Reversing Bar, undated, 1 page (17).

Drawing of a Typical Pneumatic Actuator, including the "Miller Edge," undated, 1 page (19).

Creative Door Services Ltd., Industrial Steel Doors Brochure, undated, 4 pages.

The Cookson Company, Featheredge materials, undated, 2 pages.

*Primary Examiner*—Jerry Redman

*Attorney, Agent, or Firm*—Terrence N. Kuharchuk

[57] ABSTRACT

A safety edge for an electrically operated door includes a female housing strip adapted for attachment to an edge of a door and a male actuator strip. The female housing strip has an interior cavity in which is positioned a first electrical contact. The male actuator strip has a second electrical contact. The male actuator is telescopically received in the female housing. The male actuator strip is movable between a first position in which the second electrical contact is spaced from the first electrical contact and a second position in which the second electrical contact engages the first electrical contact.

15 Claims, 7 Drawing Sheets

32
28
62
48
60
22
52
26
52B
42
52A
76
38
44
46
47
50
30
50

74
72
66
24
70
68
64

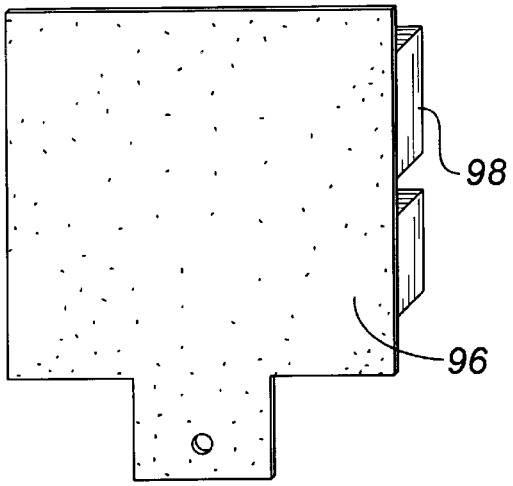
FIG. 8
FIG. 9
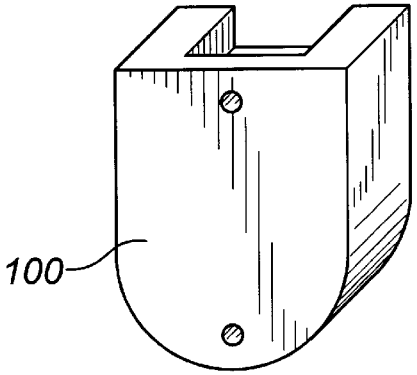
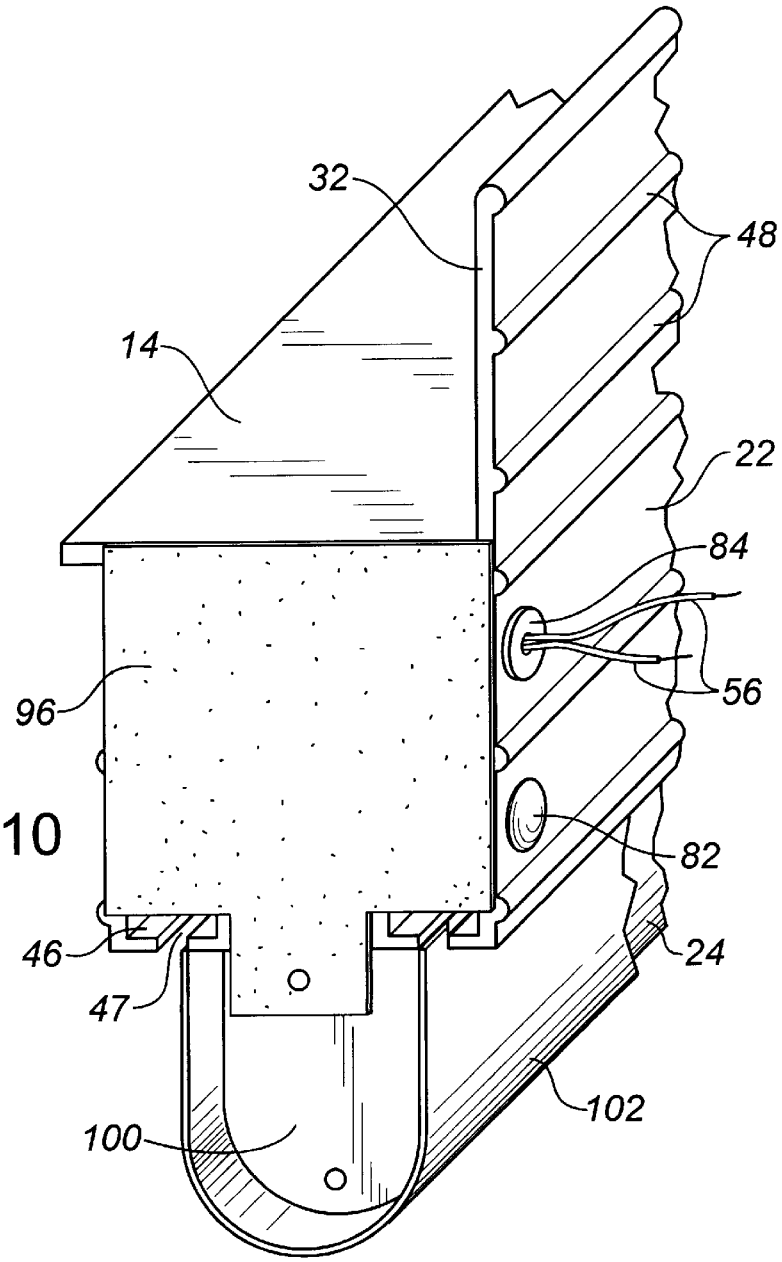
FIG. 10

SAFETY EDGE FOR AN ELECTRICALLY OPERATED DOOR

FIELD OF THE INVENTION

The present invention relates to a safety edge for an electrically operated door.

BACKGROUND OF THE INVENTION

Electrically operated doors, especially overhead doors, are inherently dangerous. During their downward travel mode, overhead doors are capable of trapping and exerting extreme force upon any object obstructing their path of travel. Therefore, a triggering device is placed upon the lower lead edge of the door which serves to reverse the direction of travel of the overhead door should an object obstruct the doors path of travel. These triggering devices are known as safety edges, although they are also referred to as reversing systems or reversing bars.

One common type of safety edge is a pneumatic system. A gum-hose is used to force air to a diaphragm operated switch. The diaphragm, when aroused by the force of said air, touches a set of electrical points together. Pneumatic systems have a number of inherent problems. The diaphragm operated switch is hidden from view and is, therefore, difficult to inspect for routine maintenance. The gum-hose has a tendency to crack, rot and leak; thereby rendering the system ineffective. Should the door encounter a narrow obstruction during downward travel, a pneumatic reversing system does not always transmit sufficient air through said gum-hose to operate the diaphragm switch. The longer the hose used (i.e. for larger or wider doors), the less effective pneumatic systems become, due to outward deflection of the longer gum-hose, reducing airflow to said diaphragm. This is especially evident when the gum-hose is compressed furthest from said diaphragm switch. On very slow moving doors, the operating capabilities of this switch are extremely limited, due to a reduced force of airflow to said diaphragm.

A more reliable and widely used system is the mechanical safety edge system. Mechanical safety edge systems consist of an extremely heavy metal rail attached to the lead edge of a door section by a hinged attachment system. The mechanical safety edge relies upon gravity to disengage one or more electric switches fastened to the inner face of a bottom section of door. The metal rail pivots upwardly about its hinges upon striking an object in its path of travel. The switches are positioned to be struck by the metal rail or its linkages as it pivots. Although mechanical systems are far more reliable than pneumatic systems, they also have inherent drawbacks. The weight of the metal rail makes it difficult to attach to new lightweight doors and also causes counterbalancing problems. The linkages tend to wear or come out of alignment with the switches they are supposed to contact, thus causing the safety edge to malfunction.

A third style of safety edge is the compressible electrical contact system. This system consists of thin ribbons of copper tape, separated by foam rubber strips. The foam rubber strips are uniformly perforated, and when compressed allow the ribbons of copper tape to contact, sending an electrical signal. As with the other systems described above, this system has inherent defects. The system is housed in a canvas and/or rubber sheath. If the sheath becomes torn, cracked or perforated, the incursion of moisture creates a short in the electrical system. This type of reversing bar is also extremely expensive, and has to be manufactured to suit the length of each individual door size on which it is to be used. This presents stocking problems, as well as marketing concerns. For these reasons the compressible electrical contact system is not as widely used a system as either the pneumatic or mechanical safety edges.

SUMMARY OF THE INVENTION

What is required is an alternative safety edge for an electrically operated door that obviates some or all of the problems present in the prior art.

According to the present invention there is provided a safety edge for an electrically operated door which includes a female housing strip and a male actuator strip. The female housing strip has an interior cavity in which is positioned at least one of a first electrical contact. Means is provided for attaching the female housing strip to an edge of a door. The male actuator strip has at least one of a second electrical contact. The male actuator is telescopically received in the female housing. The male actuator strip is movable between a first position in which the second electrical contact is spaced from the first electrical contact and a second position in which the second electrical contact engages the first electrical contact to close a normally open circuit.

BRIEF DESCRIPTION OF THE DRAWINGS

These and other features of the invention will become more apparent from the following description in which reference is made to the appended drawings, wherein:

FIG. 8 is a perspective view of an end-cap for the safety edge illustrated in FIG. 1.

FIG. 9 is a perspective view of a dust plug for the safety edge illustrated in FIG. 1.

FIG. 10 is a perspective view of the safety edge illustrated in FIG. 1, with end cap, dust plug and weather strip attached.

DETAILED DESCRIPTION OF THE PREFERRED EMBODIMENT

Figure 1:
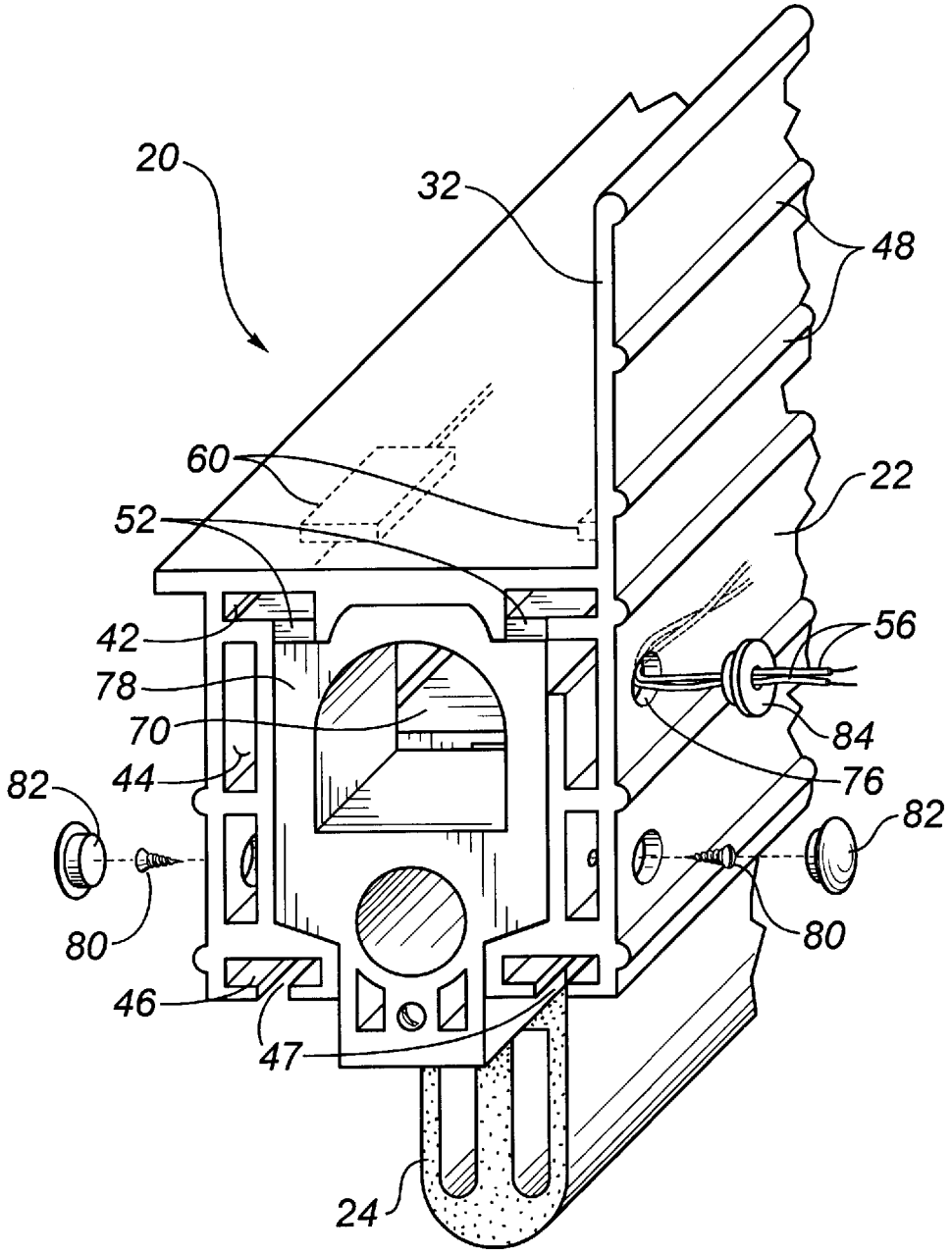
FIG. 1 is a perspective view of a safety edge constructed in accordance with the teachings of the present invention.

The preferred embodiment of safety edge, generally identified by reference numeral 20, will now be described with reference to FIGS. 1 through 12.

Figure 5:
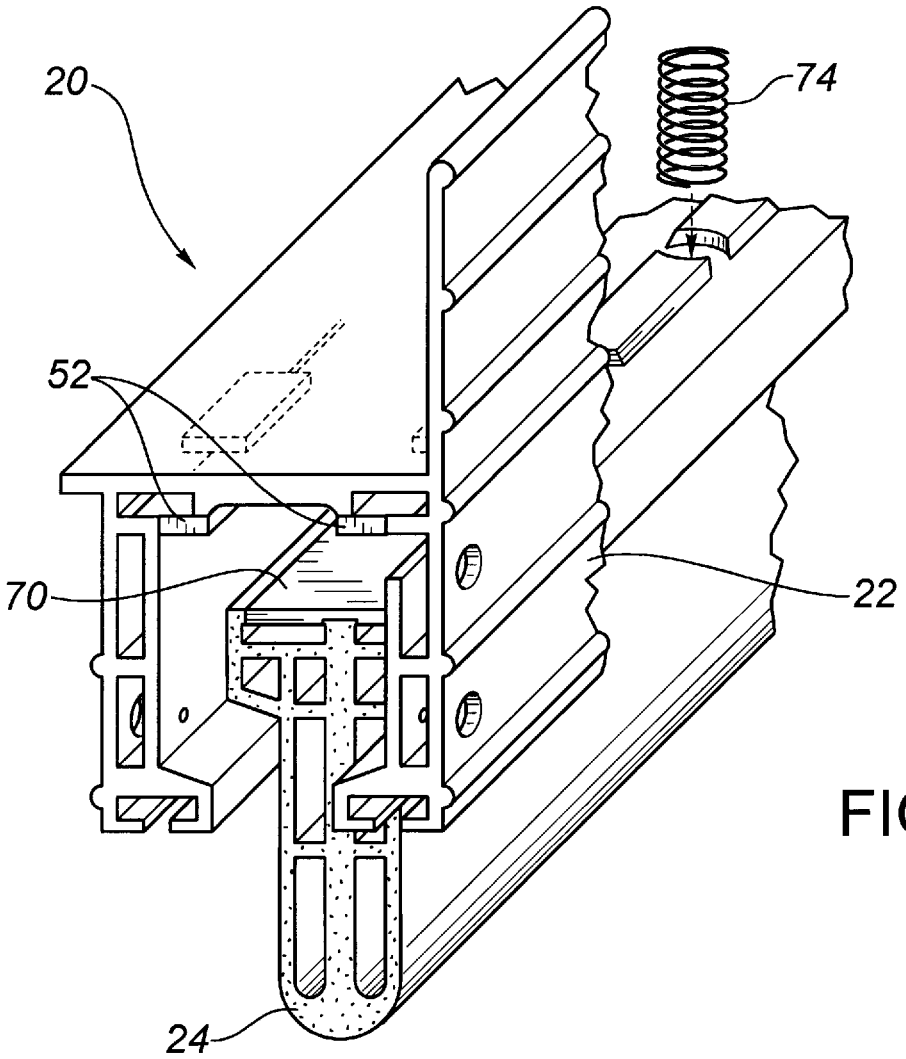
FIG. 5 is a partially cut-away perspective view of the safety edge illustrated in FIG. 1, with the end block removed.

Referring to FIGS. 1 and 5, the key components of safety edge 20 include an elongate female housing strip 22 and an elongate male plunger-actuator strip 24. Referring to FIG.

11, the length of female housing strip 22 and male plunger-actuator strip 24 can be equivalent to the width of any overhead door. In actual practise, female housing strip 24 will be made in standard lengths with a plurality of female housing strips 24 being joined to make up any required width, as will hereinafter be further explained. Female housing strip 22 is separately illustrated in FIG. 2. Male plunger-actuator strip 24 is separately illustrated in FIG. 3. It will be understood that the following description of safety edge 20 as employed on an overhead door bottom section is by way of example only, as the safety edge of the present invention may also be advantageously employed in other applications, such as, rolling steel door bottom rails, rolling shutter door bottom bars, as well as gates and sliding panels, and the like.

Figure 2:
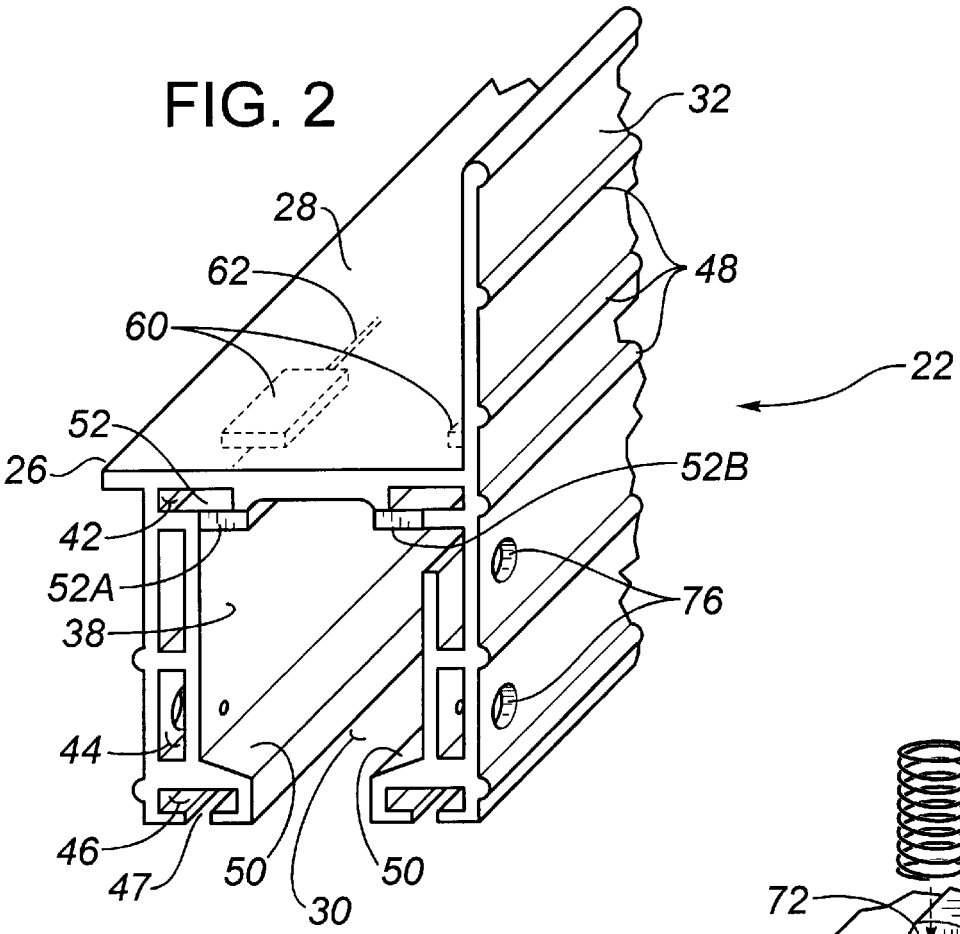
FIG. 2 is a perspective view of a female housing strip for the safety edge illustrated in FIG. 1.
Figure 11:
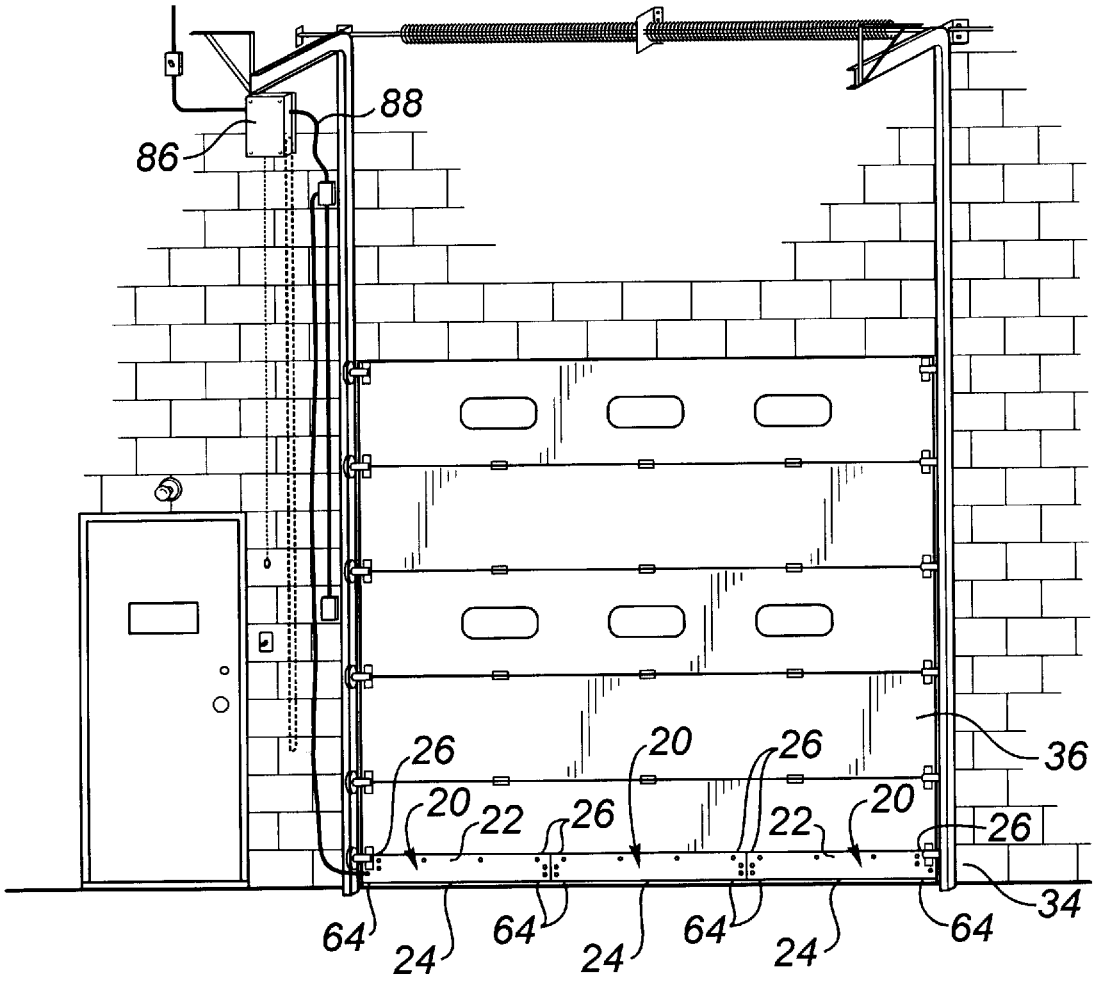
FIG. 11 is a perspective view of the safety strip illustrated in FIG. 10, on a typical, electrically operated overhead door.
Figure 12:
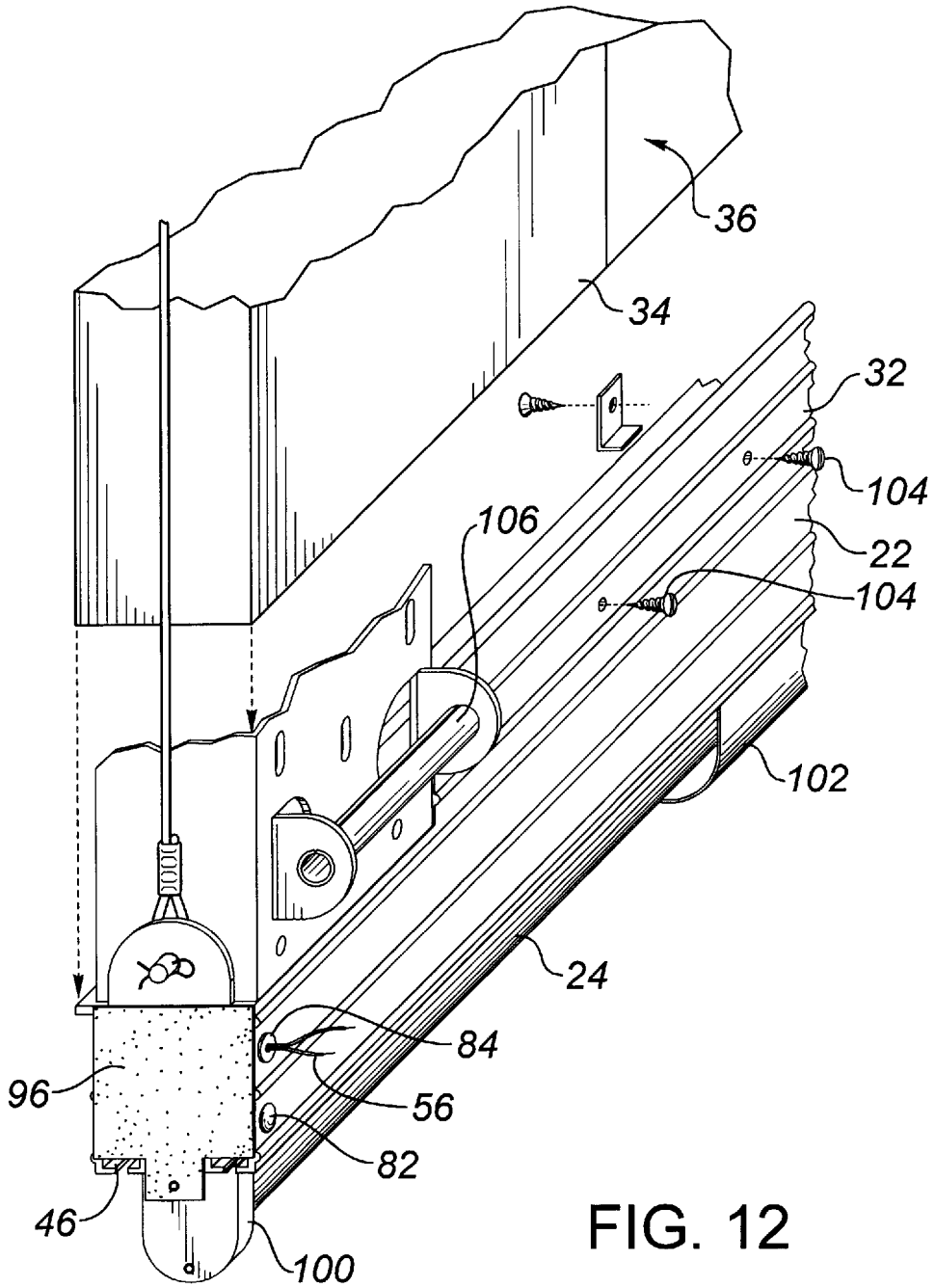
FIG. 12 is a partially cut-away detailed perspective view of the safety strip attached to an overhead door, as illustrated in FIG. 11.

Referring to FIG. 11, each female housing strip 22 has opposed ends 26. Referring to FIG. 2, each female housing strip 22 has a "C" channel body 28 which defines an interior cavity 30. "C" channel body 28 has an integrally formed vertically extending attachment flange 32. Referring to FIG. 12, attachment flange 32 serves as means for attaching female housing strip 22 to an edge 34 of a door 36. Referring to FIG. 2, "C" channel body 28 has an interior wall 38, an exterior wall 40, and a plurality of channels 42, 44 and 46 disposed between interior wall 38 and exterior wall 40. Each of channels 42, 44, and 46 extend between opposed ends 26. Channels 46 have longitudinally extending slots 47, the purpose of which will hereinafter be further described. Attachment flange 32 and exterior walls 40 have longitudinally extending exterior reinforcing ribs 48. It is preferred that female housing strip 24 and, in particular, attachment flange 32 be constructed of a lightweight plastic material. This enables portions of attachment flange 32 to be cut away, to accommodate a variety of obstacles, while still maintaining adequate support for female housing strip 22. Interior cavity 30 of female housing strip 22 has internal shoulders 50. Within interior cavity 30 is positioned first electrical contact means 52. First electrical contact means can take a variety of forms, as long as it is compatible with a second electrical contact to complete a normally open circuit, as will hereinafter be further described. In this embodiment, first electrical contact means 52 includes a positive electrical contact 52*a* and a negative electrical contact 52*b* in spaced relation. Positive electrical contact 52*a* and negative electrical contact 52*b* are separately illustrated in FIG. 4. Each of positive electrical contact 52*a* and negative electrical contact 52*b* consist of a copper strip formed into a clip-form body 54. To each clip-form body 54 is connected insulated conductive wires 56. It is preferred that an insulating gasket 58 be placed so as to maintain spacing between clip-form body 54 and conductive wires 56. Referring to FIG. 2, clip-form body 54 is used to clip positive electrical contact 52*a* and negative electrical contact 52*b* onto opposed ends 26 of female housing strip 22. When clipped in position, positive electrical contact 52*a* and negative electrical contact 52*b* are accessible for electrical contact from both interior cavity 30 and from channels 42.

Figure 3:
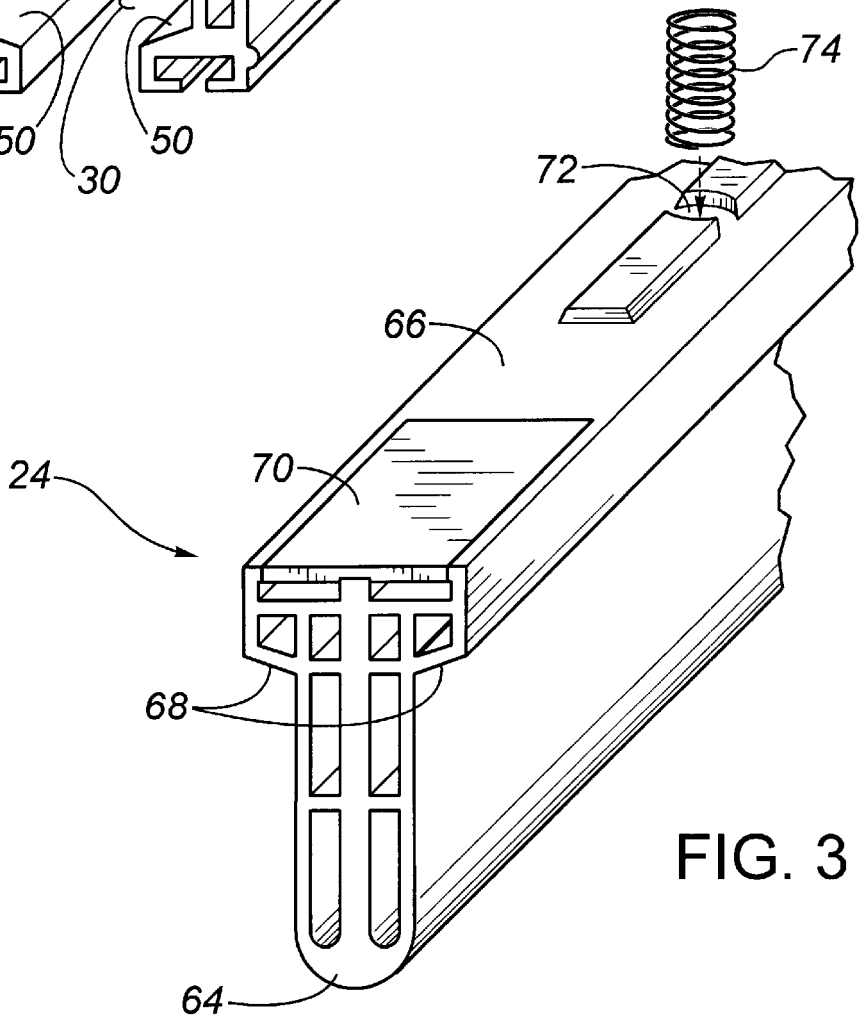
FIG. 3 is a perspective view of a male actuator strip for the safety edge illustrated in FIG. 1.
Figure 4:
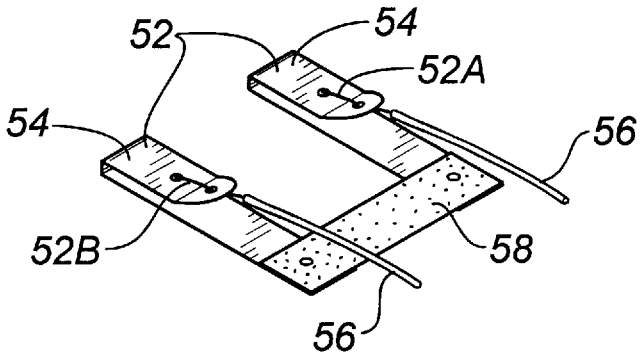
FIG. 4 is a perspective view of an electrical contact assembly for the female housing strip illustrated in FIG. 2.

Referring to FIG. 11, male plunger-actuator strip 24 is generally elliptical in transverse section and has opposed ends 64. Referring to FIG. 3, male plunger-actuator strip 24 has a top edge 66 and external shoulders 68 which are spaced toward top edge 66. Top edge 66 has second electrical contact 70 at each of opposed ends 64. Second electrical contact 70 is a "bridge" contact that spans between positive electrical contact 52*a* and negative electrical contact 52*b*, as hereinafter will be further described. Pockets 72 are positioned at intervals along top edge 66. Spring 74 are received in and protrude from pockets 72.

Referring to FIG. 5, male plunger-actuator strip 24 is telescopically received within an interior cavity 30 of female housing strip 22. Male plunger-actuator strip 24 is movable between a first position in which second electrical contact 70 is spaced from first electrical contact 52 and a second position in which second electrical contact 70 engages first electrical contact 52 to close a normally open circuit. Springs 74 serve to bias male plunger-actuator strip 24 toward the first position. External shoulders 68 on male plunger-actuator strip 24 engage internal shoulders 50 within interior cavity 30 of female housing strip 22 to prevent male plunger-actuator strip 24 from being withdrawn from female housing strip 22 when in the first position. Male plunger-actuator strip 24 moves to the second position to cause second electrical contact 70 to come into contact with first electrical contact 52 when an obstruction is encountered in its path of travel. Having first electrical contact 52 at each of opposed ends 26 of female housing strip 22 and second electrical contact means 70 at each of opposed ends 64 of male plunger actuator strip 24, enables safety edge 20 to operate in a safe manner even when struck at one end only.

Figure 6:
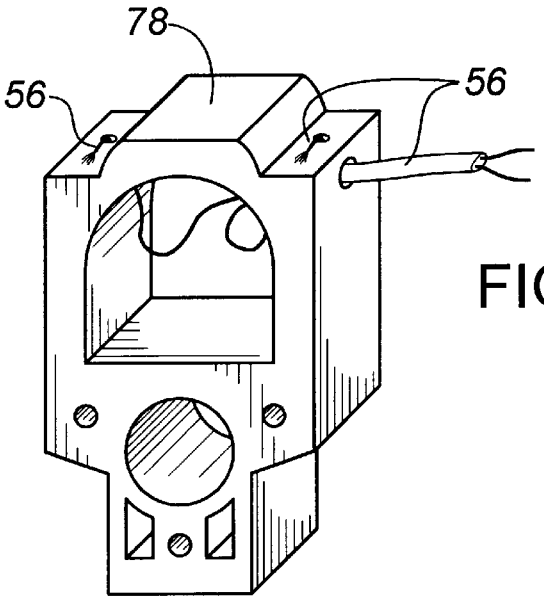
FIG. 6 is a perspective view of an endblock for the safety edge illustrated in FIG. 1.

Referring to FIG. 2, body 28 of female housing strip 22 has two sidewall access ports 76 at each of opposed ends 26. Referring to FIG. 6, an endblock 78 is illustrated. Endblock serves as a conduit for conductive wires 56. Referring to FIG. 1, endblock 78 is attached with assembly screws 80, and conductive wires 56 hidden behind a plastic cover plug 82. To access wires 56, cover plug 82 may be replaced with a rubber grommet 84 through which said wires 56 may protrude for hookup. Endblock 78 provides strength to the female housing strip 22, and assists in maintaining male plunger-actuator strip 24 in its proper orientation within interior cavity 30 of female housing strip 22. Referring to FIG. 11, completion of an electrical circuit is achieved by connecting conductive wires 56 to an electrical door opener 86 by means of an electrical cord 88.

Figure 7:
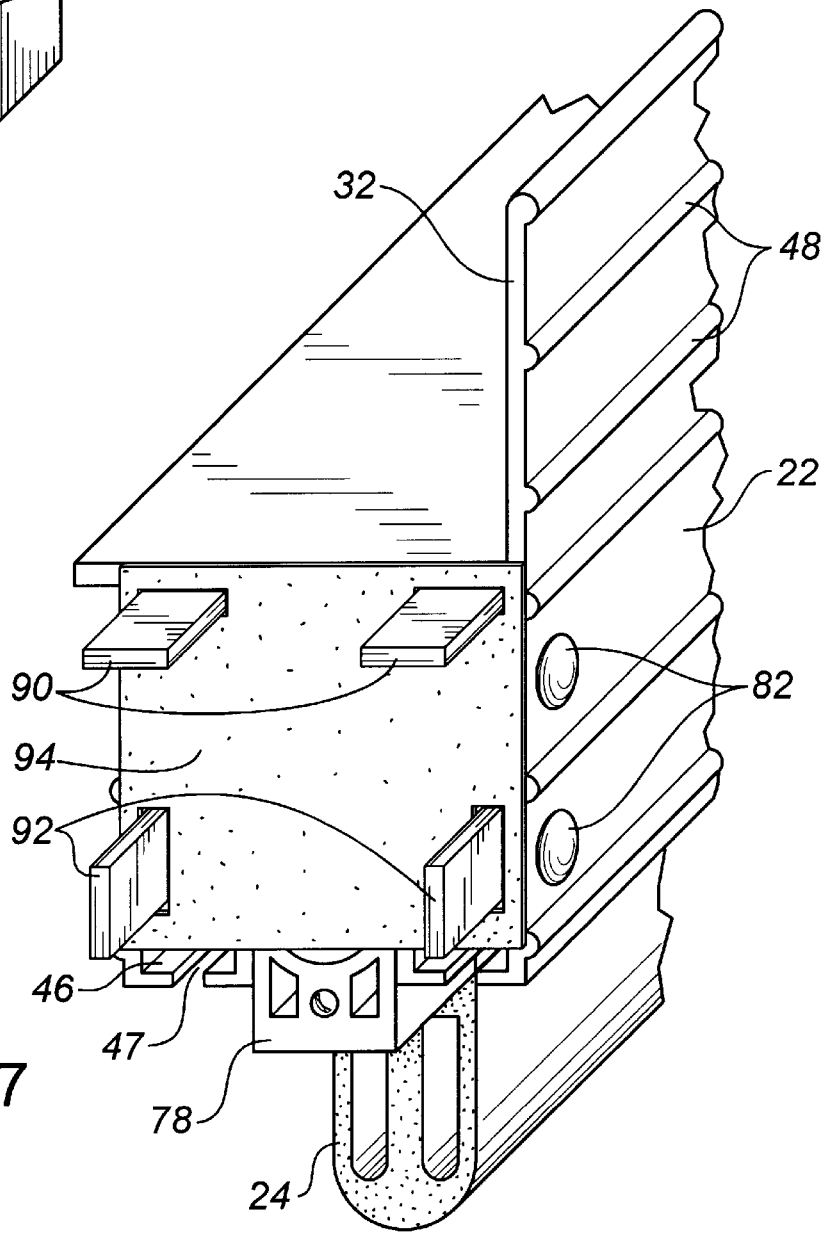
FIG. 7 is a perspective view of a module of the safety edge illustrated in FIG. 1, with gasket and connective members.

Safety edge 20 is intended to be used in modular sections. Referring to FIG. 11, two or more substantially identical safety edges 20, when coupled together, will achieve the required safety edge length to correspond to the length of an edge 34 of door 36 on which they are to be installed. The safety edge is constructed in such a manner as to allow its individual use for door sections of small length, or in a series, for use on door sections of greater length. Referring to FIG. 7, interconnection between two identical safety edges 20 is accomplished using copper interlocks 90 and plastic alignment plugs 92. Copper interlocks 90 extend through a gasket 94 into channels 42 of female housing strip 22 where they make an electrical connection with electrical contacts 52. In order to prevent copper interlocks 90 from going completely into channels 42, plastic positioning stops 60 are provided, which limit the distance that copper interlocks 90 can be extended into channels 42. Plastic alignment plugs 92 similarly extend into channels 44. Copper interlocks 90 are made of phosphor-copper, commonly used in many high quality electrical switches, to provide durability and conductivity of great reliability.

Plastic alignment plugs 92 maintain the alignment of female housing strip 22 of one of safety edges 20, with female housing strip 22 of a next adjoining safety edge 20. Referring to FIG. 8, an optional end cover plate 96 is illustrated. End cover plate 96 has protruding plugs 98 that are adapted to be received in channels 44 of female housing strip 22. Referring to FIG. 10. when connection to an adjacent safety edge 20 is not required, cover plate 96 is used to complete opposed end 26 of female housing strip 22.

Referring to FIG. 9, an optional foam rubber dust plug 100 is illustrated. Referring to FIG. 10, dust plug 100 is used to complete opposed end 64 of male plunger-actuator strip 24. Dust plug 100 is secured in position by a screw (not shown). Referring to FIG. 10, it is preferred that a rubber weatherstrip 102 be attached to female housing strip 22 covering male plunger-actuator strip 24. This prevents debris from entering into interior cavity 30 of female housing strip 22. Weatherstrip 102 is retained in channels 46 and extends out through slots 47. Weatherstrip 102 is easily slid into position by sliding along slot 47 from one of opposed ends 64.

The use and operation of safety edge 20 will now be described with reference to FIGS. 1 through 12. Referring to FIG. 11, a plurality of safety edges 20 are secured in end to end relation along edge 34 of door 36. Referring to FIG. 12, each safety edge 20 is secured to edge 34 of door 36 flange 32. Attachment flange 32 may be cut away as required to avoid obstacles, such as bottom lifting fixture 106. Referring to FIG. 7, the end to end connection of safety edges 20 is accomplished by extending copper interlocks 90 into channels 42 of female housing strip 22 where they make an electrical connection with electrical contacts 52. Plastic alignment plugs 92 similarly extend into channels 44 to provide stability to the connection. Referring to FIG. 5, male plunger-actuator strip 24 moves to the second position to cause second electrical contact 70 to come into contact with first electrical contact 52 when an obstruction is encountered in its path of travel. The electrical contact between second electrical contact 70 and first electrical contact 52 can be made at either of opposed ends 64 and 26, respectively, which enables safety edge 20 to operate in a safe manner even when struck at one end only. Referring to FIG. 11, having a plurality of safety edges 20 improves the weather seal with the floor by virtue of the independent action of each male plunger-actuator strip 22 in safety edge 20. This independent action better accommodates an angular drainage slope on a floor as angular deflection of male plunger-actuator strip 22 follows an angled floor line when forced down by the closing of overhead door 36.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A safety edge for an electrically operated door, comprising:

a female housing strip having an interior cavity in which is positioned at least one first electrical contact means;

means for attaching the female housing strip to an edge of a door; and a male actuator strip having at least one second electrical contact means, the male actuator strip being telescopically received in the female housing strip, the male actuator strip being movable between a first position in which the second electrical contact means is spaced from the first electrical contact means and a second position in which the second electrical contact means engages the first electrical contact means to close a normally open circuit.

2. The safety edge as defined in claim 1, wherein the first electrical contact means includes a positive electrical contact and a negative electrical contact in spaced relation, and the second electrical contact means on the male actuator strip includes at least one bridge contact that spans between the positive electrical contact and the negative electrical contact to close the normally open circuit.

3. The safety edge as defined in claim 1, wherein the female housing strip has opposed ends, wherein one of the first electrical contact means is positioned at each of the opposed ends of the female housing strip, wherein the male actuator strip has opposed ends, and wherein one of the second electrical contact means is positioned at each of the opposed ends of the male actuator strip such that one of the first electrical contact means is engagable with one of the second electrical contact means to close the normally open circuit at either of the opposed ends of the female housing strip.

4. The safety edge as defined in claim 1, wherein the female housing strip is a "C" channel.

5. The safety edge as defined in claim 1, wherein a stop means prevents the male actuator strip from being withdrawn from the female housing strip.

6. The safety edge as defined in claim 1, wherein biasing means are disposed between the female housing strip and the male actuator strip to bias the male actuator strip toward the first position.

7. The safety edge as defined in claim 1, wherein the female housing strip has opposed ends, an interior wall, an exterior wall, and a plurality of channels disposed between the interior wall and the exterior wall, the channels extending between the opposed ends.

8. The safety edge as defined in claim 1, wherein the female housing strip has longitudinally extending exterior reinforcing ribs.

9. The safety edge as defined in claim 1, wherein the safety edge comprises a safety edge unit, and wherein a plurality of safety edge units are connected together.

10. The safety edge as defined in claim 9, further comprising a connector comprising at least one connective member for connecting adjacent safety edge units together both structurally and electrically.

11. The safety edge as defined in claim 10, wherein each female housing strip of the plurality of safety edge units has opposed ends, wherein adjacent female housing strips have adjacent opposed ends, and wherein the connector connects the adjacent opposed ends of the adjacent female housing strips.

12. The safety edge as defined in claim 11, wherein each female housing strip has an interior wall, an exterior wall and a plurality of channels disposed between the interior wall and the exterior wall, the channels extending between the opposed ends of the female housing strip, and wherein the connector comprises at least one connective member insertable into at least one of the plurality of channels at the adjacent opposed ends of the adjacent female housing strips.

13. The safety edge as defined in claim 12, wherein the first electrical contact means comprises a pair of first electrical contacts positioned in the interior cavity of each female housing strip, one of the pair of first electrical contacts positioned at one of the opposed ends of the female housing strip and another of the pair of first electrical contacts positioned at another of the opposed ends of the female housing strip, and wherein the pair of first electrical contacts is connected by wiring extending along at least a portion of at least one of the plurality of channels.

14. A safety edge for an electrically operated door, comprising:

a "C" channel female housing strip having an interior cavity, opposed ends, an interior wall, an exterior wall, and a plurality of channels disposed between the interior wall and the exterior wall, the channels extending between the opposed ends, a first electrical contact positioned within the interior cavity at both the opposed ends, wires extending along at least one of the plurality of channels connecting the first electrical contact at each of the opposed ends, each of the first electrical contacts including a positive electrical contact and a negative electrical contact in spaced relation;

means for attaching the female housing strip to an edge of an automatic door;

a male actuator strip having opposed ends, a second electrical contact including a bridge contact positioned at both of the opposed ends, the male actuator strip being telescopically received in the female housing strip, the male actuator strip being movable between a first position in which the second electrical contact is spaced from the first electrical contact and a second position in which the bridge contact of one of the second electrical contacts spans between the positive electrical contact and the negative electrical contact of one of the first electrical contacts to close a normally open circuit;

biasing means being disposed between the female housing strip and the male actuator strip to bias the male actuator strip toward the first position; and stop means preventing the male actuator strip from being withdrawn from the female housing strip when in the first position.

15. In combination:

a door having an edge;

a plurality of modular "C" channel female housing strips secured to the edge of the door, each of the female housing strips having an interior cavity, opposed ends, an interior wall, an exterior wall, and a plurality of channels disposed between the interior wall and the exterior wall, the channels extending between the opposed ends, a pair of first electrical contacts positioned within the interior cavity, one of the pair of first electrical contacts at one of the opposed ends and another of the pair of first electrical contacts at another of the opposed ends, wires extending along at least one of the plurality of channels connecting the pair of first electrical contacts;

at least one connector comprising a plurality of connective members insertable into the plurality of channels at one of the opposed ends of each of two female housing strips to structurally and electrically connect adjacent female housing strips in end to end relation; and a plurality of modular male actuator strips, each male actuator strip having opposed ends, a pair of second electrical contacts positioned on the male actuator strip, one of the pair of second electrical contacts at one of the opposed ends and another of the pair of second electrical contacts at another of the opposed ends, one of the plurality of male actuator strips being telescopically received in each of the plurality of female housing strips, each male actuator strip being movable between a first position in which each of the pair of second electrical contacts is spaced from the first electrical contacts and a second position in which at least one of the pair of second electrical contacts engages at least one of the pair of first electrical contacts to close a normally open circuit.

* * * * *